US007239072B2

(12) United States Patent
Snijkers-Hendrickx et al.

(10) Patent No.: US 7,239,072 B2
(45) **Date of Patent: *Jul. 3, 2007**

(54) FLUORESCENT LAMP AND METHOD OF MANUFACTURING

(75) Inventors: Ingrid Jozef Maria Snijkers-Hendrickx, Eindhoven (NL); Henricus Albertus Maria Van Hal, Eindhoven (NL); Wilhelmus Cornelis Keur, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 94 days.

This patent is subject to a terminal disclaimer.

(21) Appl. No.: 10/516,150

(22) PCT Filed: May 27, 2003

(86) PCT No.: PCT/IB03/02399

§ 371 (c)(1),
(2), (4) Date: Nov. 30, 2004

(87) PCT Pub. No.: WO03/105184

PCT Pub. Date: Dec. 18, 2003

(65) Prior Publication Data

US 2005/0206320 A1 Sep. 22, 2005

(30) Foreign Application Priority Data

Jun. 5, 2002 (EP) ..... 02077200

(51) Int. Cl.
*H01J 1/62* (2006.01)

(52) U.S. Cl. ..... 313/493

(58) Field of Classification Search ..... 313/493, 313/489, 571, 573, 637, 640, 642
See application file for complete search history.

(56) References Cited

U.S. PATENT DOCUMENTS

| | | | | | |
|---|---|---|---|---|---|
| 4,541,811 | A | * | 9/1985 | Mulder et al. | 445/26 |
| 4,684,847 | A | * | 8/1987 | Spierings et al. | 313/493 |
| 4,940,923 | A | * | 7/1990 | Kroontje et al. | 315/248 |
| 5,051,653 | A | * | 9/1991 | DeBoer et al. | 313/489 |
| 5,473,226 | A | * | 12/1995 | Beschle et al. | 313/580 |
| 5,753,999 | A | * | 5/1998 | Roozekrans et al. | 313/493 |
| 5,801,483 | A | | 9/1998 | Watamabe et al. | |

FOREIGN PATENT DOCUMENTS

| | | | |
|---|---|---|---|
| EP | 0448170 | A1 | 9/1991 |
| EP | 0448170 | B1 | 1/1995 |
| WO | WO0156350 | A2 | 8/2001 |
| WO | WO0156350 | A3 | 8/2001 |

* cited by examiner

*Primary Examiner*—Shih-Chao Chen
*Assistant Examiner*—Minh Dieu A

(57) ABSTRACT

A low-pressure mercury vapor discharge lamp is provided with a light-transmitting discharge vessel, enclosing, in a gastight manner, a discharge space provided with a filling of mercury and a rare gas. The discharge vessel comprises means for maintaining a discharge in the discharge space. At least a portion of an inner wall of the discharge vessel is provided with a translucent layer which-according to the invention has a thickness in the range from 1 to 50 μm and comprises an alkaline-earth-borate.

13 Claims, 2 Drawing Sheets

FLUORESCENT LAMP AND METHOD OF MANUFACTURING

Figure 1A:
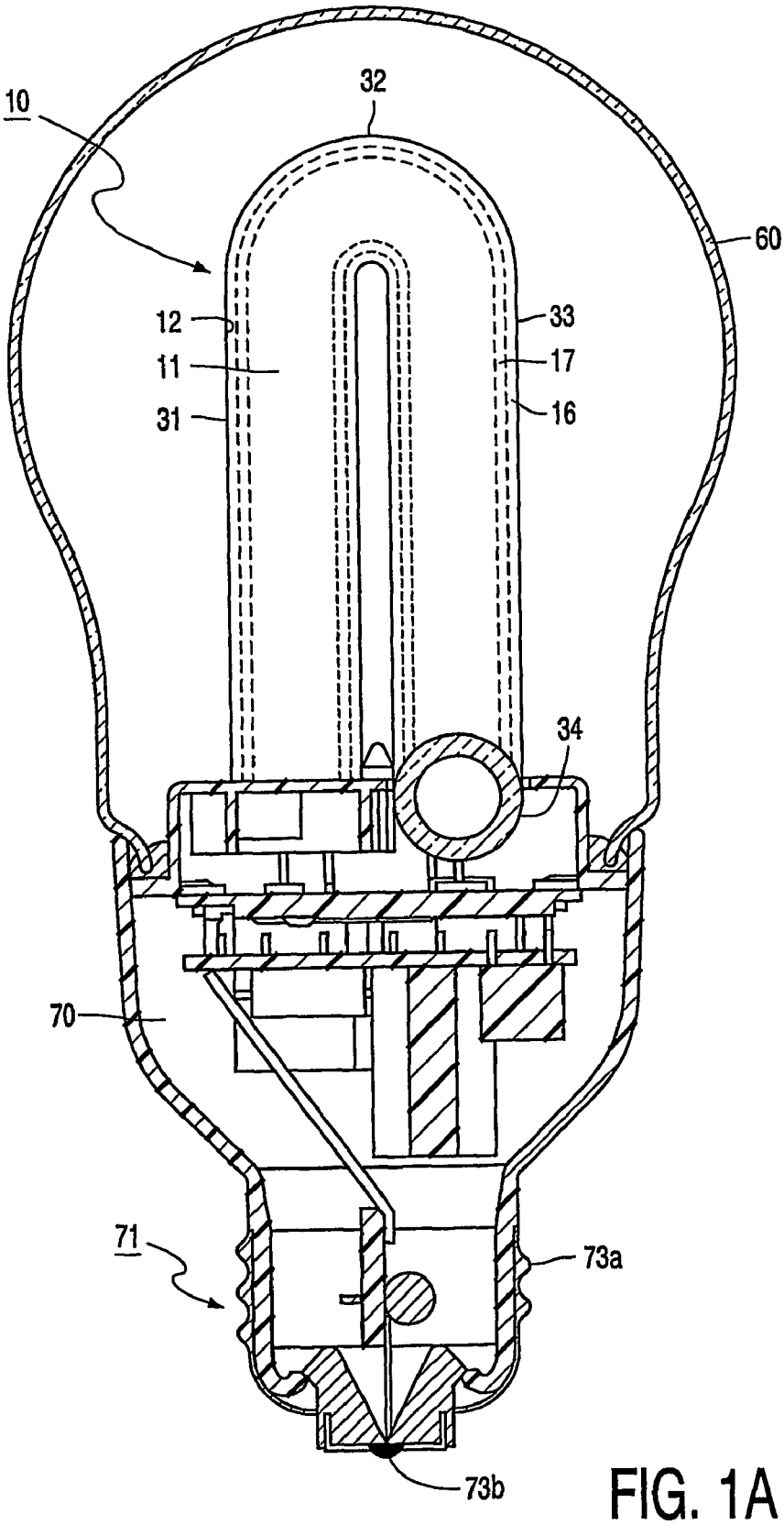

This application is a 371 of PCT/IB03/02399 May 27, 2003.

The invention relates to a low-pressure mercury-vapor discharge lamp comprising a light-transmitting discharge vessel, the discharge vessel enclosing, in a gastight manner, a discharge space provided with a filling of mercury and a rare gas, the discharge vessel comprising means for maintaining a discharge in the discharge space, while at least a portion of an inner wall of the discharge vessel is provided with a translucent layer.

The invention also relates to a compact fluorescent lamp.

The invention, in addition, relates to a method of manufacturing a fluorescent lamp.

In mercury-vapor discharge lamps, mercury constitutes the primary component for the (efficient) generation of ultraviolet (UV) light. A luminescent layer comprising a luminescent material (for example, a fluorescent powder) may be present on an inner wall of the discharge vessel to convert UV to other wavelengths, for example, to UV-B and UV-A for tanning purposes (sun panel lamps) or to visible radiation for general illumination purposes. Such discharge lamps are therefore also referred to as fluorescent lamps. The discharge vessel of a low-pressure mercury-vapor discharge lamp is usually tubular and circular in cross-section and comprises both elongate and compact embodiments. Generally, the tubular discharge vessel of so-called compact fluorescent lamps comprises a collection of relatively short straight parts having a relatively small diameter, which straight parts are connected together by means of bridge parts or arc-shaped parts. Compact fluorescent lamps are usually provided with an (integrated) lamp cap.

It is known that measures are taken in low-pressure mercury-vapor discharge lamps to inhibit blackening of parts of the inner wall of the discharge vessel, which parts are in contact with a discharge which, during operation of the discharge lamp, is present in the discharge space. Such blackening, which is brought about by interaction between mercury and the glass from which the discharge vessel is made, is undesirable and does not only lead to a reduction of the lumen maintenance but also to an unaesthetic appearance of the lamp, particularly because the blackening occurs irregularly, for example, in the form of dark stains or dots.

A low-pressure mercury-vapor discharge lamp of the type described in the opening paragraph is known from WO-A 01/56350. The translucent layer provided on an inner surface of the discharge vessel of the know low-pressure mercury-vapor discharge lamp comprises a borate or a phosphate of an alkaline-earth metal and/or of scandium, yttrium, or another rare earth metal. The translucent layer in the known discharge lamp has a thickness of between 5 and 200 nm.

A drawback of the use of the known low-pressure mercury-vapor discharge lamp is that its lumen maintenance still is relatively poor due to said blackening. As a result, in addition, a relatively large amount of mercury is necessary for the known lamp in order to realize a sufficiently long service life. This is detrimental to the environment in the case of injudicious processing after the end of the service life.

It is an object of the invention to eliminate the above disadvantage wholly or partly. In particular, it is an object of the invention to provide a low-pressure mercury-vapor discharge lamp of the type described in the opening paragraph which has an improved lumen maintenance. According to the invention, a low-pressure mercury-vapor discharge lamp of the kind mentioned in the opening paragraph is for this purpose characterized in that the translucent layer comprises an alkaline earth borate, and in that the thickness of the translucent layer is in a range from 1 to 50 μm.

A discharge vessel of a low-pressure mercury-vapor discharge lamp according to the invention with a translucent layer having the above composition and with a thickness in the range given above appears to be very well resistant to the action of the mercury and rare gas atmosphere which, in operation, prevails in the discharge vessel of the low-pressure mercury-vapor discharge lamp. As a result, blackening due to interaction between mercury and the glass from which the discharge vessel is manufactured is reduced, resulting in an improved lumen maintenance. During the service life of the discharge lamp, a smaller quantity of mercury is withdrawn from the discharge, so that, in addition, a reduction of the mercury consumption of the discharge lamp is obtained and a smaller mercury dose will suffice in the manufacture of the low-pressure mercury-vapor discharge lamp.

Blackening caused by removal of mercury from the discharge occurs in straight parts as well as in arc-shaped parts of the low-pressure mercury-vapor discharge lamp. In general, blackening is reduced by providing the inner wall of the discharge vessel with a sufficiently adhering and sufficiently thick translucent layer. In general, the arc-shaped lamp parts of compact fluorescent lamps are more subject to blackening than the straight lamp parts. The arc-shaped lamp parts are generally not bent until after the tubular discharge vessel has been provided with the translucent layer and, if necessary, a luminescent layer. In the bending operation, the thickness of the translucent layer in the arc-shaped lamp parts is reduced and the translucent layer is stretched, which may result in the formation of cracks in the translucent layer. Crack formation occurs in the known discharge lamp when the thickness of the translucent layer is less than 500 nm. The application of a translucent layer according to the invention causes blackening to be substantially reduced in the straight parts as well as in the arc-shaped parts of the low-pressure mercury-vapor discharge lamp.

In the known discharge lamp, the translucent layer is made by flushing the discharge vessel with a solution of a mixture of suitable metal-organic compounds, for example yttrium acetate mixed with calcium, strontium, and/or barium acetate, and an acid diluted in water, for example boric acid, while the desired translucent layer is obtained after drying and sintering. It has been observed, in particular during bending to form the arc-shaped parts of the discharge lamp, that the translucent layer fuses itself to the wall of the discharge vessel and that some sodium diffuses out of the wall of the discharge vessel. This gives rise to a higher mercury consumption and to blackening of the discharge vessel, in particular in the arc-shaped parts of the low-pressure mercury-vapor discharge lamp. To prevent the (complete) fusion of the translucent layer to the wall of the discharge vessel, it would be desirable to be able to increase the thickness of the translucent layer. In the known discharge lamp this is not possible because the flushing solution becomes saturated. This is the reason why in the known discharge lamp, the thickness of the translucent layer is limited to a few 100 nm.

The inventors have had the recognition that by using "nano-particles" of alkaline earth borates, in particular calcium, strontium, and/or barium borate, a translucent layer can be made with a thickness which can be significantly larger than that of the translucent layer made from the salts in the known discharge lamp. The term "nano-particles" in the description of the present invention denotes that particles with a particle size in the range from 0.1 to 1 μm. The softening point of the calcium, strontium, and/or barium borate particulate material is low enough for the particles to fuse together during the bending process. In addition, a dense translucent layer is obtained that, because of its large thickness, has not completely reacted with the subjacent wall of the discharge vessel. It was found in experiments that a translucent layer according to the invention made from nano-particles of calcium, strontium, and/or barium borate showed a relatively high point of zero charge and a relatively low mercury consumption. An additional advantage of producing the translucent layer from nano-particles of alkaline earth borates is that the size of the particles of alkaline earth borates is comparable to the wavelength of the UV light. This makes it possible to employ the translucent layer also as a reflector for UV light (the size of the particles is in the range from approximately 0.5 μm to approximately 0.6 μm). By employing the translucent layer according to the invention, a low-pressure mercury-vapor discharge lamp is obtained with a relatively low mercury consumption.

The measure according to the invention is notably suitable for compact fluorescent lamps having arc-shaped lamp parts, wherein the discharge vessel is additionally surrounded by a light-transmitting envelope. The temperature of the discharge vessel of such "covered" compact fluorescent lamps is comparatively high because the heat dissipation to the environment is reduced by the presence of the envelope. This unfavorable temperature balance adversely affects the lumen maintenance of the known discharge lamp due to an increased level of blackening. Experiments have surprisingly shown that the lumen maintenance of a compact fluorescent lamp provided with a low-pressure mercury-vapor discharge lamp according to the invention, the discharge vessel of which is surrounded by an envelope, exceeds 90% after 2000 burning hours, whereas the lumen maintenance of an identical compact fluorescent lamp provided with the known low-pressure mercury-vapor discharge lamp, the discharge vessel of which is surrounded by an envelope, is less than 80% after 2000 burning hours.

The translucent layer in the low-pressure mercury-vapor discharge lamp in accordance with the invention further satisfies the requirements with respect to light and radiation transmissivity and can be easily provided as a homogeneous translucent layer on an inner wall of a discharge vessel of a low-pressure mercury-vapor discharge lamp.

Translucent layers, as thick as 50 μm, can be made with the alkaline earth borate nano-particles. Strontium borate nano-particles are particularly suitable for producing such thick layers. Making the translucent layer thicker than approximately 50 μm would give rise to lumen losses in the low-pressure mercury-vapor discharge lamp. Preferably, the thickness of the translucent layer is in the range from 1 to 20 μm.

Very suitable is a translucent layer with a thickness in the range from 10 to 20 μm. A translucent layer thinner than approximately 10 μm could give rise to a complete reaction of the particulate calcium, strontium, and/or barium borate with the wall, in particular during bending of discharge vessels under factory conditions. The risk is higher in a production environment where the conditions cannot always be met as precisely as in laboratory experiments. It is observed that the particles in the translucent layer do not reach a temperature high enough for melting in the straight parts of the discharge vessels of compact fluorescent lamps, thus leading to diffuse scattering of light in the translucent layer. In the arc-shaped parts of the discharge vessel of compact fluorescent lamps, the particles in the translucent layer do reach a temperature high enough for melting, thus leading to a transparent layer. Preferably, the translucent layer further comprises scandium, yttrium, or a further rare earth metal. Such materials provide an extra protection against wall blackening. In particular, yttrium oxide is known in the art as a protective layer.

A preferred embodiment of the low-pressure mercury-vapor discharge lamp according to the invention is characterized in that the discharge vessel is made from a glass comprising silicon dioxide and sodium oxide, with the glass composition comprising the following essential constituents, given in percentages by weight: $SiO_2$: 60 to 80% and $Na_2O$: 10 to 20% by weight. The application of a translucent layer according to the invention in combination with the sodium-rich glass in accordance with the invention causes blackening to be substantially reduced in the straight parts as well as in the arc-shaped parts of the low-pressure mercury-vapor discharge lamp.

The glass composition preferably comprises the following constituents: $SiO_2$: 70 to 75%, $Na_2O$: 15 to 18% and $K_2O$: 0.25 to 2% by weight. The composition of such a sodium-rich glass is similar to that of ordinary window glass and it is comparatively cheap with respect to the glass used in the known discharge lamp. The cost price of the raw materials for the sodium-rich glass as used in the discharge lamp in accordance with the invention is only approximately 50% of the cost price of the raw materials for the mixed alkali glass as used in the known discharge lamp. Moreover, the conductivity of said sodium-rich glass is comparatively low; at 250° C. (approximately log $\rho$=6.3). The use of the translucent layer according to the invention yields a low-pressure mercury-vapor discharge lamp with a relatively low mercury consumption with soda-lime glass as the wall material of the discharge vessel.

A preferred embodiment of the low-pressure mercury-vapor discharge lamp according to the invention is characterized in that a side of the translucent layer facing the discharge space is provided with a layer of a luminescent material. An advantage of the use of a translucent layer according to the invention in low-pressure mercury-vapor discharge lamps is that the luminescent layer comprising a luminescent material (for example, a fluorescent powder) adheres significantly better to such a translucent layer than to a translucent layer of the known low-pressure mercury-vapor discharge lamp. Said improved adhesion is obtained particularly in the arc-shaped parts of low-pressure mercury-vapor discharge lamps.

The invention further relates to a method of manufacturing a fluorescent lamp, wherein a light-transmitting discharge vessel is provided so as to enclose, in a gastight manner, a discharge space provided with a filling of mercury and a rare gas, wherein the discharge vessel is provided with means for maintaining a discharge in the discharge space, and wherein at least a portion of an inner wall of the discharge vessel is provided with a translucent layer, characterized in that alkaline earth borate particles are used to form the translucent layer, the size of the calcium, strontium, and/or barium borate particles being in a range from 0.1 to 1 μm.

These and other aspects of the invention will be apparent from and elucidated with reference to the embodiments described hereinafter.

IN THE DRAWINGS

Figure 1B:
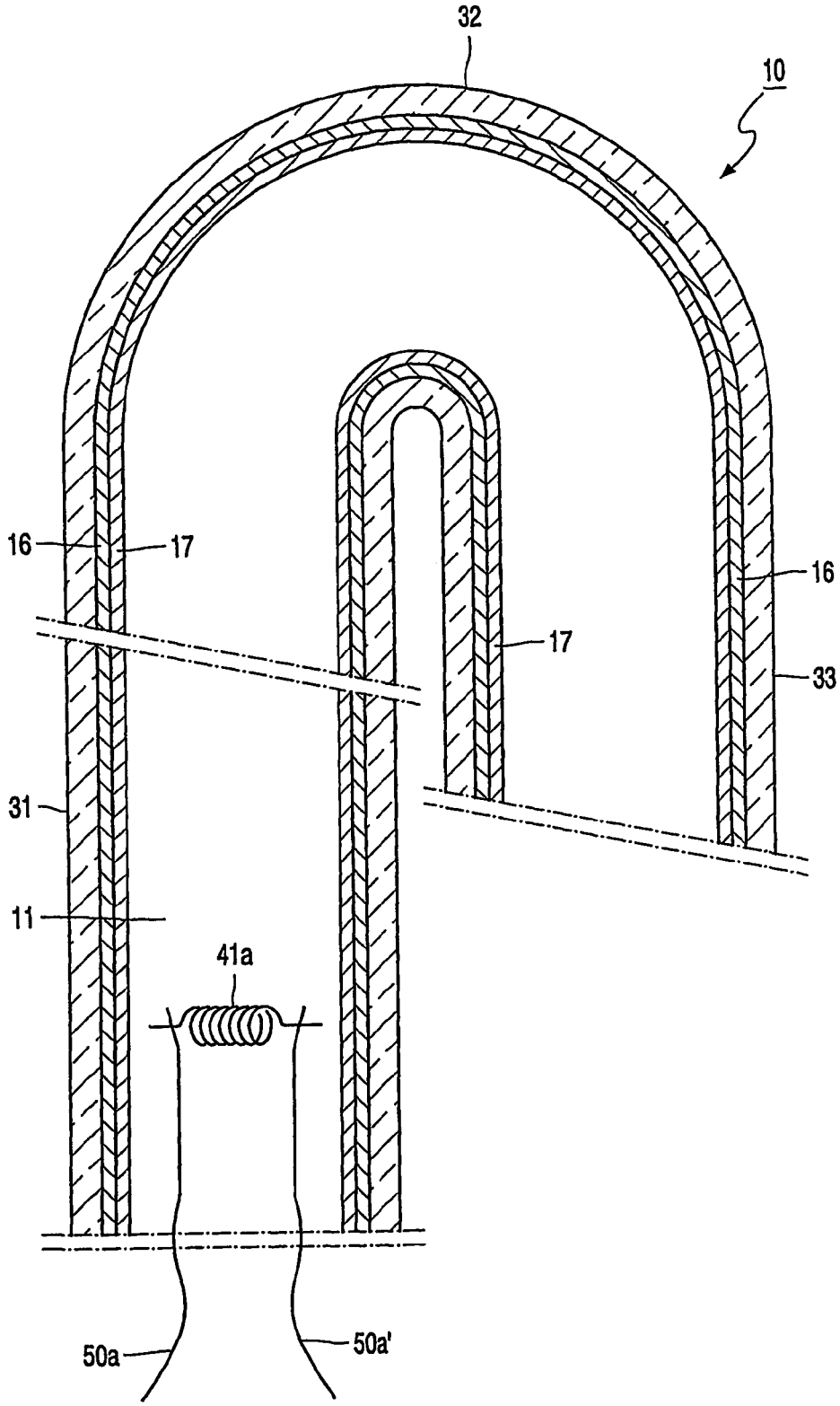

FIG. 1A is a cross-sectional view of an embodiment of a compact fluorescent lamp comprising a low-pressure mercury-vapor discharge lamp according to the invention, and FIG. 1B is a cross-sectional view of a detail of the low-pressure mercury-vapor discharge lamp as shown in FIG. 1A.

The Figures are purely diagrammatic and not drawn to scale. Particularly for clarity, some dimensions are exaggerated strongly. Similar components are denoted by the same reference numerals as much as possible in the Figures.

FIG. 1 shows a compact fluorescent lamp comprising a low-pressure mercury-vapor discharge lamp. The low-pressure mercury-vapor discharge lamp is provided with a radiation-transmitting discharge vessel 10 enclosing, in a gastight manner, a discharge space 11 having a volume of approximately 10 $cm^3$. The discharge vessel 10 is a glass tube which is at least substantially circular in cross-section and the (effective) internal diameter D of which is approximately 10 mm. The tube is bent in the form of a so-called hook and, in this embodiment, it has a number of straight parts, two of which, referenced 31, 33, are shown in FIG. 1A. The discharge vessel further comprises a number of arc-shaped parts, two of which, referenced 32, 34, are shown in FIG. 1A. An inner wall 12 of the discharge vessel 10 is provided with a translucent layer 16 according to the invention and with a luminescent layer 17. In an alternative embodiment, the luminescent layer has been omitted. The discharge vessel 10 is supported by a housing 70 which also supports a lamp cap 71 provided with electrical and mechanical contacts 73*a*, 73*b*, which are known per se. The discharge vessel 10 of the low-pressure mercury-vapor discharge lamp is surrounded by a light-transmitting envelope 60 which is attached to the lamp housing 70. The light-transmitting envelope 60 generally has a matt appearance.

FIG. 1B is a very diagrammatic cross-sectional view of a detail of the low-pressure mercury-vapor discharge lamp shown in FIG. 1A. The discharge space 11 in the discharge vessel 10 does not only comprise mercury but also a rare gas, argon in this example. Means for maintaining a discharge are constituted by an electrode pair 41*a* (only one electrode is shown in FIG. 1B) which is arranged in the discharge space 11. The electrode pair 41*a* is a winding of tungsten coated with an electron-emissive material, here a mixture of barium oxide, calcium oxide, and strontium oxide. Each electrode 41*a* is supported by an (indented) end portion of the discharge vessel 10 (not shown in FIGS. 1A and 1B). Current supply conductors 50*a*, 50*a*' issue from the electrode pair 41*a* through the end portions of the discharge vessel 10 to the exterior. The current supply conductors 50*a*, 50*a*' are connected to an (electronic) power supply which is accommodated in the housing 70 and electrically connected to the electrical contacts 73*b* at the lamp cap 71 (see FIG. 1A).

The glass of the wall of the discharge vessel of the low-pressure mercury-vapor discharge lamp has a composition comprising silicon dioxide and sodium oxide as important constituents. In the example shown in FIGS. 1A and 1B, the discharge vessel is made from a so-called sodium-rich glass, for example a glass of the following composition: 70 to 74% $SiO_2$, 16 to 18% $Na_2O$, 0.5 to 1.3% $K_2O$, 4 to 6% CaO, 2.5 to 3.5% MgO, 1 to 2% $Al_2O_3$, 0 to 0.6% $Sb_2O_3$, 0 to 0.15% $Fe_2O_3$, and 0 to 0.05% MnO by weight.

In an embodiment of the low-pressure mercury-vapor discharge lamp, the so-called nano-particles of $SrB_4O_7$ with a particle size in the range from approximately 0.1 to approximately 1 μm are used to manufacture the translucent layer 16 according to the invention. Stoichiometric quantities of $SrCO_3$ and $H_3BO_3$ are mixed and melted in a Pt crucible in air. After cooling down, the glass is crushed and milled with butyl acetate during two hours followed by 48 hours rolling with $ZrO_2$ balls. The resulting amorphous particles of $SrB_4O_7$ have an average particle size of 0.6 μm. Tubular discharge vessels were provided with a coating. After this coating operation, the discharge vessels were first dried in air at a temperature of approximately 60° C. for 15 minutes. In an alternative embodiment, the transparent coating is fixed in a shorter period of time at a higher temperature. The thickness of the translucent layer 16 ranges from approximately 1 μm to approximately 50 μm, preferably from approximately 10 μm to approximately 20 μm. In an alternative embodiment, nano-particles of $BaB_4O_7$ or $CaB_4O_7$ are used.

Subsequently, the discharge vessels were provided with a luminescent coating comprising three known phosphors, namely a green-luminescing material with terbium-activated cerium-magnesium aluminate, a blue-luminescing material with bivalent europium-activated barium-magnesium aluminate, and a red-luminescing material with trivalent europium-activated yttrium oxide. After coating, the discharge vessels were bent in the known "hook" shape having straight parts and arcuate parts. A number of said discharge vessels were subsequently assembled into low-pressure mercury-vapor discharge lamps in the customary manner. A number of these discharge lamps were subsequently provided with a transparent envelope on the basis of one of the three recipes mentioned above (see the example shown in FIG. 1A). Experiments were carried out on discharge vessels of two lengths, namely 230 mm (11 W fluorescent lamp) and 405 mm (20 W fluorescent lamp). The current intensity of the lamp during operation was 200 mA in all cases.

The lumen maintenance after 1,000 and 2,000 hours was measured for low-pressure mercury-vapor discharge lamps comprising the known discharge vessel made from a sodium-rich glass provided with a translucent layer (16) in accordance with the invention with a thickness of approximately 15 μm, which translucent layer is made from $SrB_4O_7$ nano-particles with an average size of 0.6 μm in accordance with the invention. The result of this measurement is shown in Table I. The lumen maintenance is standardized in a customary manner with respect to the value after 100 burning hours of the discharge lamp.

TABLE I

Lumen Maintenance of compact low-pressure mercury-vapor discharge lamps comprising the known discharge vessel made from a sodium-rich glass provided with a translucent layer in accordance with the invention.

| | | Lumen Maintenance (%) | | | |
|---|---|---|---|---|---|
| | | 230 mm (11 W) | | 405 mm (20 W) | |
| | | 1000 hrs | 2000 hrs | 1000 hrs | 2000 hrs |
| with envelope | translucent layer based on $SrB_4O_7$ nano-particles | 94 | 90 | 97 | 94 |
| | no translucent layer | 87 | 77 | 83 | 72 |
| without envelope | translucent layer based on $SrB_4O_7$ nano-particles | 97 | 93 | 95 | 92 |
| | no translucent layer | 92 | 89 | 91 | 85 |

Table I shows that after 1,000 and 2,000 hours the lumen maintenance of discharge lamps comprising the known discharge vessel and provided with the translucent layer according to the invention is substantially improved. The largest improvement is obtained in discharge lamps provided with a light-transmitting envelope.

The application of a translucent layer according to the invention in combination with the sodium-rich glass in accordance with the invention causes blackening to be substantially reduced in the straight parts as well as in the arc-shaped parts of the low-pressure mercury-vapor discharge lamp. Wall blackening due to interaction between mercury and the glass of the discharge vessel is reduced, resulting in an improved lumen maintenance. A smaller quantity of mercury is withdrawn from the discharge during the service life of the low-pressure mercury-vapor discharge lamp, so that a reduction of the mercury consumption of the discharge lamp is obtained and a smaller mercury dose suffices in the manufacture of the low-pressure mercury-vapor discharge lamp.

It will be evident that many variations are possible to those skilled in the art within the scope of the invention.

The scope of protection of the invention is not limited to the examples given herein. The invention is embodied in each novel characteristic and each combination of characteristics. Reference numerals in the claims do not limit the scope of protection of the claims. The word "comprising" does not exclude the presence of elements other than those mentioned in the claims. The use of the word "a" or "an" in front of an element does not exclude the presence of a plurality of such elements.

The invention claimed is:

1. A low-pressure mercury-vapor discharge lamp comprising a light-transmitting discharge vessel, the discharge vessel enclosing, in a gastight manner, a discharge space provided with a filling of mercury and a rare gas, the discharge vessel comprising means for maintaining a discharge in the discharge space, while at least a portion of an inner wall of the discharge vessel is provided with a translucent layer, characterized in that:

the translucent layer comprises an alkaline earth borate, and the thickness of the translucent layer is in a range from 1 to 50 μm.

2. A low-pressure mercury-vapor discharge lamp as claimed in claim 1, characterized in that the translucent layer comprises $SrB_4O_7$.

3. A low-pressure mercury-vapor discharge lamp as claimed in claim 1, characterized in that the translucent layer further comprises scandium, yttrium, or a further rare earth metal.

4. A low-pressure mercury-vapor discharge lamp as claimed in claim 1, characterized in that the thickness of the translucent layer is in a range from 1 to 20 μm.

5. A low-pressure mercury-vapor discharge lamp as claimed in claim 4, characterized in that the thickness of the translucent layer is in a range from 10 to 20 μm.

6. A low-pressure mercury-vapor discharge lamp as claimed in claim 1, characterized in that the discharge vessel is made from a glass comprising silicon dioxide and sodium oxide, with the glass composition comprising the following essential constituents, given in percentages by weight:

| | |
|---|---|
| $SiO_2$ | 60 to 80%, |
| $Na_2O$ | 10 to 20%. |

7. A low-pressure mercury-vapor discharge tamp as claimed in claim 6, characterized in that the glass composition includes the following constituents:

| | |
|---|---|
| $SiO_2$ | 70 to 75% |
| $Na_2O$ | 15 to 18% |
| $K_2O$ | 0.25 to 2% by weight. |

8. A low-pressure mercury-vapor discharge lamp as claimed in claim 1, characterized in that a side of the translucent layer facing the discharge space is provided with a layer of a luminescent material.

9. A compact fluorescent lamp comprising a low-pressure mercury-vapor discharge lamp as claimed in claim 1, characterized in that a lamp housing is attached to the discharge vessel of the low-pressure mercury-vapor discharge lamp, which lamp housing is provided with a lamp cap.

10. A compact fluorescent lamp as claimed in claim 9, characterized in that the discharge vessel of the low-pressure mercury-vapor discharge lamp is surrounded by a light-transmitting envelope which is attached to the lamp housing.

11. Method of manufacturing a fluorescent lamp, wherein:

a light-transmitting discharge vessel is provided which encloses, in a gastight manner, a discharge space provided with a filling of mercury and a rare gas;

the discharge vessel is provided with means for maintaining a discharge in the discharge space; and at least a portion of an inner wall of the discharge vessel is provided with a translucent layer, characterized in that alkaline earth borate particles are used to form the translucent layer, the size of the calcium, strontium, and/or barium borate particles being in a range from 0.1 to 1 μm wherein the translucent layer further comprises an alkaline earth borate having thickness in a range from 1 to 50 μm.

12. Method of manufacturing a fluorescent lamp as claimed in claim 11, characterized in that the discharge vessel is made from a glass comprising silicon dioxide and sodium oxide, with the glass composition comprising the following essential constituents, given in percentages by weight:

| | |
|---|---|
| $SiO_2$ | 60 to 80%, |
| $Na_2O$ | 10 to 20%. |

13. Method of manufacturing a fluorescent lamp as claimed in claim 11, characterized in that $SrB_4O_7$ particles are used to form the translucent layer.

* * * * *